US006232568B1

(12) United States Patent
Hasegawa et al.

(10) Patent No.: US 6,232,568 B1
(45) Date of Patent: May 15, 2001

(54) CURRENT INTERRUPTING APPARATUS

(75) Inventors: Tetsuya Hasegawa; Noboru Yamaguchi, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/326,606

(22) Filed: Jun. 7, 1999

(30) Foreign Application Priority Data

Jun. 8, 1998 (JP) ..... 10-159523

(51) Int. Cl.[7] ..... H01H 39/00
(52) U.S. Cl. ..... 200/61.08
(58) Field of Search ..... 200/61.08; 180/271, 180/279; 429/7, 115, 116, 121; 307/10.1–10.8

(56) References Cited

U.S. PATENT DOCUMENTS 4,224,487 * 9/1980 Simonsen ..... 200/61.08
5,535,842 7/1996 Richter et al. ..... 180/279
5,621,197 * 4/1997 Bender et al. ..... 200/61.08
5,818,121 * 10/1998 Krappel et al. ..... 200/61.08 X
5,818,122 * 10/1998 Miyazawa et al. ..... 307/10.7
5,877,563 * 3/1999 Krappel et al. ..... 200/61.08
6,078,108 * 6/2000 Froschl ..... 307/10.7

FOREIGN PATENT DOCUMENTS 9-251830 9/1997 (JP) .

* cited by examiner

*Primary Examiner*—J. R. Scott
(74) *Attorney, Agent, or Firm*—Oblon, Spivak, McLelland, Maier & Neustadt, P.C.

(57) ABSTRACT

A current interrupting apparatus including a battery terminal adapted to be attached to a battery, a load conductor wire adapted to be connected to a load, a connecting member electrically connecting the load conductor wire and the battery terminal, and a cutting device configured to cut the connecting member when an interruption control signal is input thereto. The cutting of the connecting member by the cutting device interrupts the supply of electric current from the battery to the load by way of the battery terminal and the load conductor wire.

12 Claims, 9 Drawing Sheets

CURRENT INTERRUPTING APPARATUS

BACKGROUND OF THE INVENTION

The present invention relates to a current interrupting apparatus and, more particularly, to a current interrupting apparatus which, at the time of, for example, a vehicle in abnormality, interrupts the supply of an electric current from the battery to a load in the vehicle.

Japanese Patent Application Laid-Open Publication No. 9-251830 discloses an on-vehicle-loaded circuitry that includes a current interrupting apparatus.

SUMMARY OF THE INVENTION

According to the studies that have been made by the inventors of the present invention, in a current interrupting apparatus that has been provided in a vehicle, when some abnormality occurs in, for example, a wire harness that connects a battery and respective loads in the vehicle and that is provided with a plurality of electric wires, it is necessary to make an interruption between the battery and the wire harness and thereby protect the respective loads, etc.

According to the further analysis of the present inventors, on-vehicle-loaded circuitry that includes circuitry for the current interrupting apparatus has a construction as shown in FIG. 13.

Namely, such on-vehicle-loaded circuitry has a battery 101, a circuit breaker 102 connected to a battery electrode of the battery 101, and an electronic device 106 for an engine that is connected to the battery 101 through a consumption device conductor wire 109 and circuit breaker 102.

Upon occurrence of the abnormality in the vehicle, the circuit breaker 102 is operated under the control of a controller 110. Thus, the battery conductor wire 103 is separated from the battery 101 and the consumption device conductor wire 109 is also separated from the battery 101 and the battery conductor wire 103.

A detailed construction of such a circuit breaker 102 is illustrated in FIG. 14.

The circuit breaker 102 is mounted on an electrode 101' of the battery 101 through a cable terminal 111. and has a gas generator 112.

By use of the gaseous pressure, the gas generator 112 pushes a clamp portion 114 out from a clamp portion 113 to thereby separate the battery conductor wire 103 that has been engaged by the clamp portion 114 from the clamp portion 113 and hence from the battery electrode 101' of the battery 101.

Specifically, the circuit breaker 102 has a connecting portion 115 provided with a joint mover 118, a contact portion 116 connected to the clamp portion 113 through the connecting portion 115, the consumption device conductor wire 109 connected to the contact portion 116, and a plastic covering portion 117 surrounding the circuit breaker 102.

And, when the gas generator 112 is ignited, the battery conductor wire 103 is thrown away and, at this time, the joint mover 118 is moved together with the battery conductor wire 103. Therefore, the connection portion 115 and contact portion 116 are interrupted between them. And, the consumption device conductor wire 109 is separated from the battery conductor wire 103 and separated from the battery electrode 101' of the battery 101, with the result that the supply of an electric current to the electronic device 106 for the engine is also stopped.

However, in the above-described construction, it is considered that the electric resistance varies depending upon the interfitting precision between the clamp portions 113 and 114. In such a case, the value of the current from the battery 101 to the load 106 inconveniently varies.

Also, in order to interrupt the supply of the current, the circuit breaker 102 necessitates the provision of the gas generator 112, clamp portions 113, 114, connection portion 115, contact portion 116, plastic covering portion 117, joint mover 118, etc. This means that the circuit breaker 102 is of a complex structure. And therefore, the circuit breaker 102 becomes high in cost.

An object of the present invention is to provide a current interrupting apparatus which, while reliably supplying an electric current to a respective load at a normal time, stops reliably the supply of the electric current to the load at an abnormal time and which is small in the number of structural parts, simple in structure and low in cost.

To attain the above object, the current interrupting apparatus according to the present invention comprises a battery terminal attached to a battery; a load conductor wire connected to a load; a connecting member electrically connected the load conductor wire and the battery terminal; and a cutting device configured to cut the connecting member when an interruption control signal is input thereto. Here, a supply of an electric current from the battery to the load by way of the battery terminal and the load conductor wire is interrupted when the cutting device cuts the connecting member.

According to such a construction, although at a normal time the supply of the current to the load is being reliably effected from the battery through the battery terminal, connecting member and load conductor wire, at an abnormal time such as a vehicle collision time the interruption control signal is input to the cutting device from the outside. And as a result the cutting device cuts the connecting member. Accordingly, it is possible to interrupt the supply of the current from the battery to the load instantaneously and reliably. Also, it is possible to provide a current interrupting apparatus which is small in the number of structural parts, simple in structure, and low in cost.

More specifically, it is preferable that the cutting device comprises an explosives portion accommodating explosives, an igniting device igniting the explosives accommodated in the explosives portion, and a cutter portion cutting the connecting member by use of an explosion force generated by the explosives when the explosives are ignited by the igniting device.

According to such a construction, when the igniting device explodes by igniting the explosives accommodated in the explosives portion, the cutter portion cuts the connecting portion by the explosion force of the explosives. Therefore, it is possible to interrupt the supply of the current from the battery to the load instantaneously and reliably.

Also, it is preferable that the cutting device is inserted into a part, suitably a main body portion, of the battery terminal and is fixed therein. This configuration is preferred because only a small amount of space is needed therefor and because the device is simplified and inexpensive.

Also, more specifically, there can be adopted a construction wherein the connecting member has a conductor wire-assembling terminal that is to be connected to the load conductor wire, and an attaching portion for attaching the conductor-wire-assembling terminal to the battery terminal. Here, the cutting device cuts the conductor wire-assembling terminal.

According to such a construction, since the load conductor wire side is reliably separated from the terminal main body portion simultaneously with the cutting of the conductor-wire-assembling terminal, the supply of the current from the battery to the load can be reliably interrupted.

In this configuration, the conductor wire-assembling terminal is passed through a cavity portion formed within the cutting device, and the cutting device cuts the conductor wire-assembling terminal that has been passed,through the cavity portion.

On the other hand, there can be adopted a construction wherein the connecting member has a conductor-wire-assembling terminal that is to be connected to the load conductor wire, and an attaching portion for attaching the conductor-wire-assembling terminal to the battery terminal. Here, the cutting device cuts the attaching portion.

According to such a construction, since the load conductor wire side is reliably separated from the terminal main body portion simultaneously with the cutting of the attaching portion, the supply of the current from the battery to the load can be reliably interrupted.

From this point of view, there can be adopted a construction wherein the attaching portion is a fastening portion for fastening and fixing the conductor wire-assembling terminal to the battery terminal, and the fastening portion is passed through the cavity portion formed within the cutting device. Here, the cutting device cuts the fastening portion that has been passed through the cavity portion. More specifically, the fastening portion may have a bolt that is passed through the cavity formed within the cutting device, and the cutting device cuts the bolt.

Also, there may be made a construction wherein the connecting member has a conductor wire-assembling terminal that is to be connected to the load conductor wire and an attaching portion for attaching the conductor wire-assembling terminal to the battery terminal; the conductor wire-assembling terminal has a hole portion; the attaching portion is a fastening portion for fastening and fixing the conductor wire-assembling terminal to the battery terminal; and the fastening portion has a head portion, a neck portion that is joined to the head portion and passed through the hole portion, and a bolt that is joined to the neck portion and that has a screw portion whose diameter is larger than the diameter of the hole portion and that is cut by the cutting device.

According to this construction, in a normal state, the neck portion of the fastening portion is passed through the hole portion of the conductor wire-assembling terminal and, by the screw portion, the conductor wire-assembling terminal is screwed to the terminal main body portion. However, at the time of a vehicle abnormality, when the cutting device cuts the bolt as a result of the input of the interruption control signal, the bolt is moved, and in addition the large-diameter screw portion presses the small-diameter hole portion, by the reaction force of this operation. Therefore, the conductor wire-assembling terminal is also moved. For this reason, since the load conductor wire side is reliably separated from the terminal main body portion, the supply of the current from the battery to the load can be effectively interrupted.

Meanwhile, there may be made a construction wherein the connecting member has a conductor wire-assembling terminal that is to be connected to the load conductor wire and an attaching portion for attaching the conductor-wire-assembling terminal to the battery terminal; the conductor wire-assembling terminal has a hole portion having a large-diameter portion and a small-diameter portion; the attaching portion is a fastening portion for fastening and fixing the conductor-wire-assembling terminal to the battery terminal; and the fastening portion has a head portion, a neck portion that is joined to the head portion and passed through the hole portion, and a bolt that is joined to the neck portion and that has a screw portion whose diameter is larger than the diameter of the small-diameter portion of the hole portion and that is cut by the cutting device. Owing to such a construction, the assembling efficiency of the conductor wire-assembling terminal is also enhanced.

Also, it is preferable that the connecting member has a conductor wire-assembling terminal that is to be connected to the load conductor wire and an attaching portion for attaching the conductor wire-assembling terminal to the battery terminal; and the conductor wire-assembling terminal is extended in the direction of the gravity. This is because the movement of the conductor wire-assembling terminal becomes speedy and reliable due to its own weight.

DETAILED DESCRIPTION OF THE PREFERRED EMBODIMENTS

Respective embodiments of the present invention will now be sequentially explained in detail with suitable reference to the drawings.

First, a first embodiment of the present invention will be explained with the use of FIGS. 1 and 2.

Figure 1:
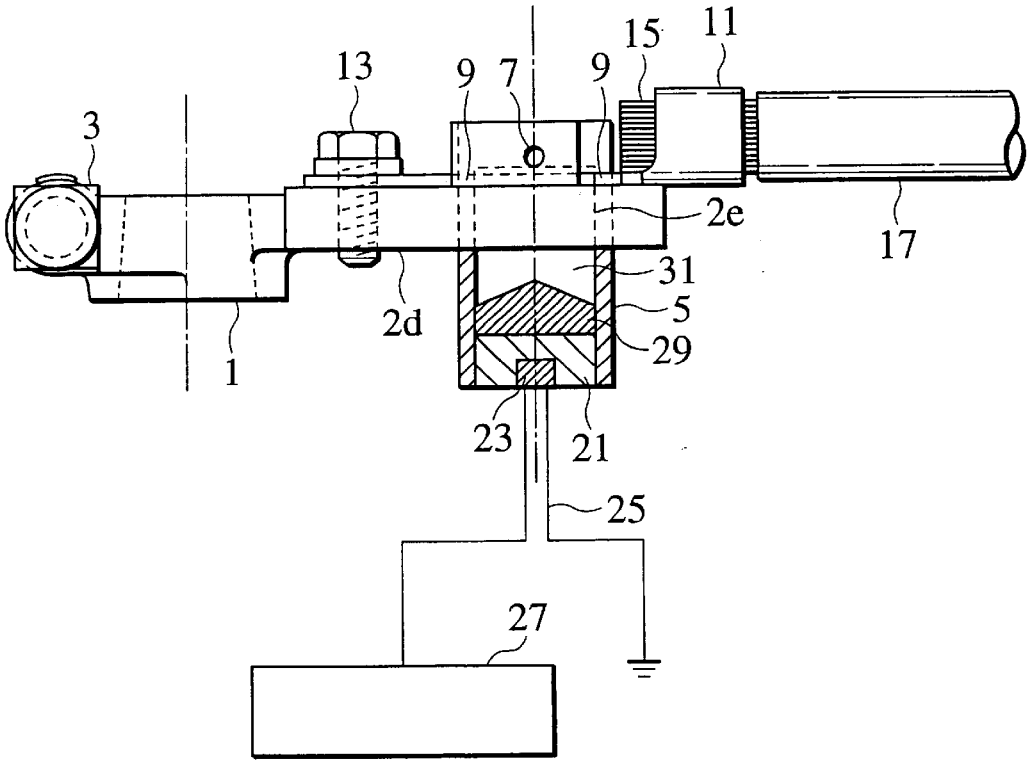
FIG. 1 is a side view including a partly sectional view showing a current interrupting apparatus according to a first embodiment of the present invention.
Figure 2:
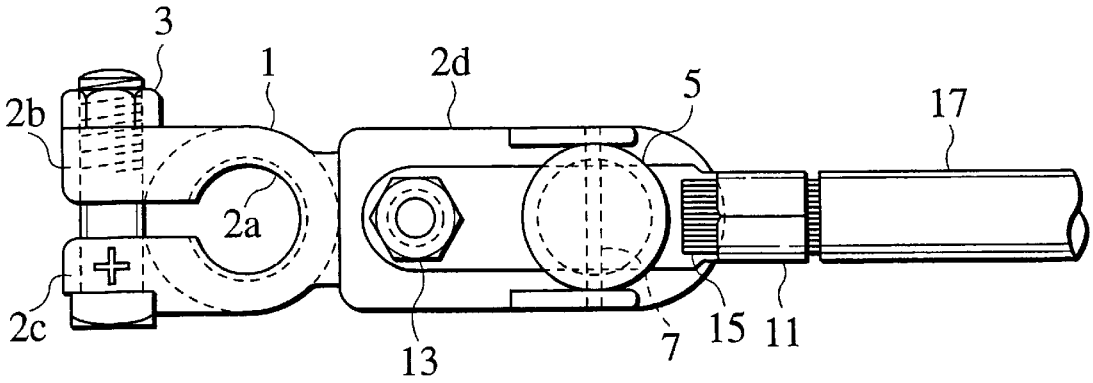
FIG. 2 is a plain view showing the current interrupting apparatus of the embodiment.

A current interrupting apparatus illustrated in FIG. 1 is installed in a vehicle and, when an abnormality signal has been inputted, the apparatus interrupts the supply of a current from a battery to a load.

In the current interrupting apparatus of FIG. 1, a battery terminal 1 that is composed of an electric conductor and attached to a battery (not illustrated) has a circular arc portion 2*a* having a center axis in the vertical direction in the figure, flange portions 2*b*, 2*c* extending in one of the horizontal directions in the figure from the circular arc portion 2*a*, and a terminal main body portion 2*d* extending in a direction opposite to the one of the horizontal directions from the circular arc portion 2*a*.

A bolt/nut mechanism 3 is arranged to fasten the flange portions 2*b*, 2*c*. By this fastening, a battery electrode (not illustrated) that is inserted through the circular arc portion 2*a* is fastened such that that the battery terminal 1 is attached to the battery.

The terminal main body portion 2*d* is provided with a cylindrical through-hole 2*e* that has a center axis in the vertical direction in the figure. A cutting device 5 is coaxially passed through the through-hole 2*e* so as to be disposed in the through-hole 2*e*. The cutting device 5 is provided with a pin 7 for fixing the cutting device 5 to the terminal main body portion 2*d*, and two through-apertures 9 that pass through a circular-cylindrical cavity 31 provided in the cutting device 5.

At an upper portion of the terminal main body portion 2*d*, there is disposed a battery-assembling terminal 11 that is composed of an electric conductor. To the battery-assembling terminal 11, there is connected a battery cable 17 in which an electric wire 15 is disposed so as to be covered by an outer insulator. And, the battery cable 17 is connected to a load not illustrated (the loads such as a starting motor, head lights, an air conditioner or the like).

The battery-assembling terminal 11 passes through the through-apertures 9 provided in the cutting device 5 and extends up to a bolt/nut mechanism 13. The bolt/nut mechanism 13 fastens the battery-assembling terminal 11 and the terminal main body portion 2*d* provided to the battery terminal 1. As a result of this, the battery terminal 1 and a battery cable 17 are electrically connected to each other through the battery-assembling terminal 11.

Also, the current interrupting apparatus is provided with a control unit 27 that outputs an abnormality signal to the cutting device 5 through a signal line 25 at the time of, for example, a vehicle accident, corresponding to activation of an air bag, generation of an excessively large current, generation of an excessively high heat or the like.

The cutting device 5 cuts the battery-assembling terminal 11 when the abnormality signal is inputted to the cutting device 5 from the control unit 27. Meanwhile, the cutting device 5 has an explosives portion 21 for receiving explosives therein, an igniting device 23, and a cutter portion 29.

The igniting device 23 is a heater or the like, and is disposed within the explosives portion 21. When the abnormality signal is inputted to the igniting device 23 from the control unit 27, the igniting device 23 ignites the explosives in the explosives portion 21 and the explosives in the explosives portion 21 explodes. A cutter portion 29 is disposed on the explosives portion 21 in such a manner that the cutter portion 29 is pushed upward by the explosion force of the explosives in the explosives portion 21 and thereby cuts the battery-assembling terminal 11. A forward end portion of the cutter portion 29 sharpens so as to surely facilitate the cutting of the battery-assembling terminal 11.

Then, the operation of the current interrupting apparatus according to the first embodiment of the present invention constructed in the above-described way is explained in detail.

First, in a case where the vehicle is in an ordinary state, the cutting device 5 is kept inoperative. Therefore, the battery terminal 1 is electrically connected to the battery cable 17 through the battery-assembling terminal 11 and therefore supply of a current is made from the battery to the load.

Then, when a vehicle abnormality such as, for example, a vehicle collision has occurred, the abnormality signal is sent from the controller unit 27 to the igniting device 23 through the signal line 25. Then, the igniting device 23 is ignited with the result that the explosives in the explosive portion 21 are exploded. For this reason, since the cutter portion 29 is pushed upward by the explosion force of the explosives in the explosives portion 21, the battery-assembling terminal 11 is cut by the cutter portion 29.

At this time, since the forward end portion of the cutter portion 29 sharpens, the battery-assembling terminal 11 that is being cut receives a force acting toward the battery cable 17 side (in FIG. 1, in the rightward direction), and is moved, due to the reaction force of such a push-up force.

Therefore, the battery-assembling terminal 11 ceases to contact with the battery terminal 1. As a result of this, the supply of the electric current from the battery to the load is interrupted.

In this way, according to the current interrupting apparatus of the first embodiment, at the time when the vehicle is in abnormality as at the time of a vehicle collision, the current interruption of the circuit of the vehicle can be spontaneously and reliably attained in accordance with the abnormality signal. As a result of this, it is possible to prevent damages of the load at the time of a vehicle collision or the like.

Also, the current interrupting apparatus of the present invention is simply provided with the battery terminal 1, battery cable 17, battery-assembling terminal 11 and cutting device 5. In addition, the battery terminal 1 and the cutting device 5 are assembled together. Therefore, it is possible to reduce the number of the structural parts and reduce the overall cost at the same time.

Also, if removing the cutting device 5 from the terminal main body portion 2*d* of the battery terminal 1, such a battery terminal can be used as in a case of an ordinary battery terminal, of course.

Next, a current interrupting apparatus according to a second embodiment of the present invention will be explained with reference to FIG. 3.

Figure 3:
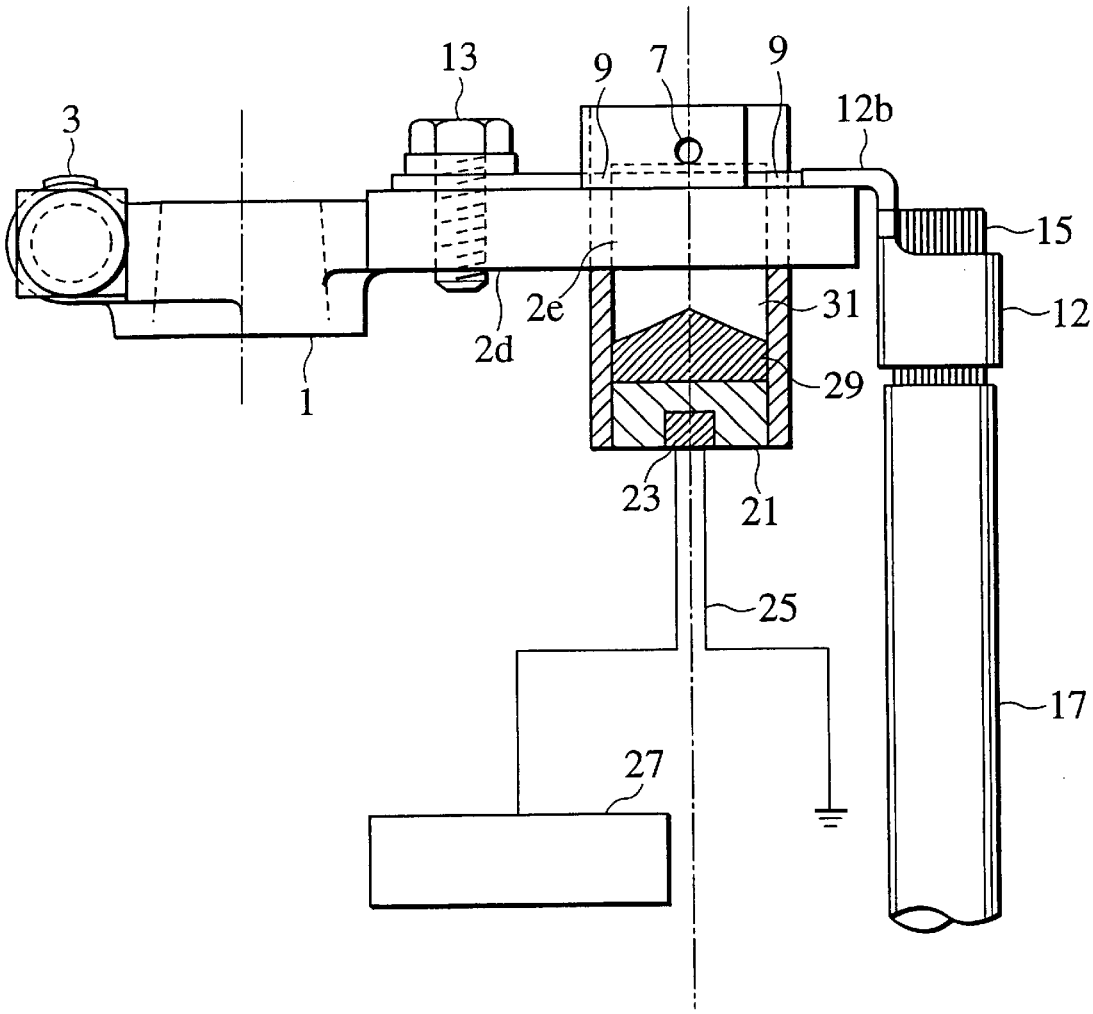
FIG. 3 is a side view including a partly sectional view showing a current interrupting apparatus according to a second embodiment of the present invention.

Although in the current interrupting apparatus of the first embodiment illustrated in FIG. 1 the battery cable 17 has been disposed in parallel with the battery terminal 1, the current interrupting apparatus of a second embodiment illustrated in FIG. 3 is specified in such a manner that the battery cable 17 is disposed orthogonally to the battery terminal 1 and is thereby extended in the vertical direction in the figure.

Thus, the battery-assembling terminal 12 is constructed so as to have a curved portion 12*b* that is prepared by its intermediate portion and is bent substantially orthogonally.

In the current interrupting apparatus illustrated in FIG. 3, the same components as those of the current interrupting apparatus described in the first embodiment are denoted by the same reference symbols, and a detailed explanation thereof will be omitted.

According to this structure, at the time when the vehicle is in abnormality, the battery-assembling terminal 12 is effectively cut by the cutter portion 29 that is provided in the cutting device 5. At this time, the battery-assembling terminal 12 is pulled rightward mainly by the weight of the battery cable 17 that acts downward in the figure. Therefore, the battery cable 17 becomes effectively separated from the side of the battery-assembling terminal 12 fastened by the bolt/nut mechanism 13.

Next, a current interrupting apparatus according to a third embodiment of the present invention will be explained with reference to FIGS. 4 to 6.

Although in the current interrupting apparatus of the first embodiment illustrated in FIG. 1 the cutting device 5 cuts the battery-assembling terminal 11 at the time when the vehicle is in abnormality, the current interrupting apparatus of the third embodiment is specified in such a manner that the cutting device 5 cuts a bolt that is passed through the cutting device 5 at the time when the vehicle is in abnormality.

A battery terminal la has a larger-thickness terminal main body portion 2*f* that is extended from the circular arc portion 2*a* and, at the outer-peripheral portion of the right side half of this terminal main body portion 2*f* in the figures, a protruding portion 2*g* is formed.

Also, in the portion of the terminal main body portion 2*f* which corresponds to the protruding portion 2*g*, there is provided a cylindrical through-hole (not illustrated) as in a case of the first embodiment. In this through-hole, a cutting device 5*a* is coaxially disposed in such a way as to be passed therethrough. The cutting device 5*a* has the pin 7 for fixing the cutting device 5*a* to the protruding portion 2*g* and two through-apertures 9*a* that pass through the circular-cylindrical cavity 31 within the cutting device 5*a*.

A battery-assembling terminal 37 is fixed to a side surface of the terminal main body portion 2*f* by a bolt/nut mechanism 33. The battery cable 17 including the electric wires 15 therein is connected to the battery-assembling terminal 37.

The bolt/nut mechanism 33 is formed with a screw thread portion 34 at the forward end of a bolt 34*a*. The bolt/nut mechanism 33 is passed through the through-apertures 9*a* and circular-cylindrical cavity 31, and is screwed to the terminal main body portion 2*f* by the screw thread portion 34.

As a result of this, the battery terminal 1*a* and the battery cable 17 are electrically connected to each other through the battery-assembling terminal 37 and the bolt/nut mechanism 33. Also, the bolt/nut mechanism 33 is covered with a cover 35.

Figure 4:
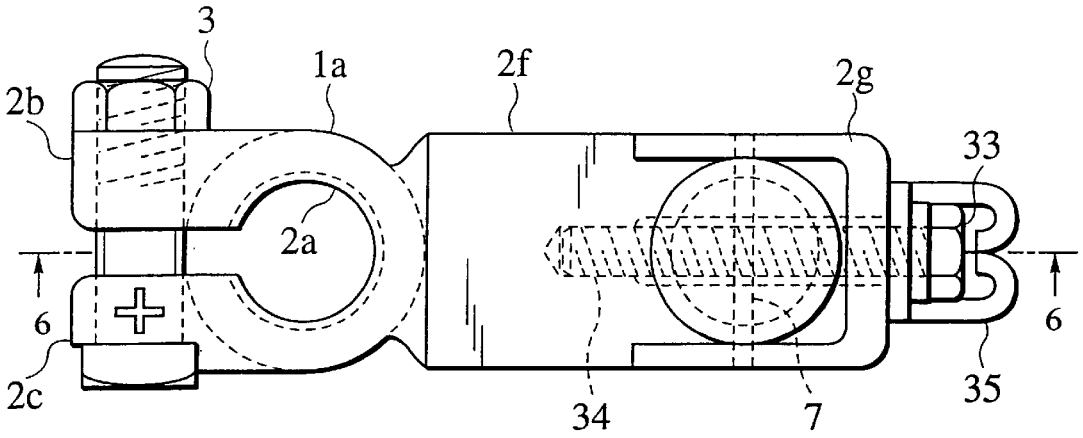
FIG. 4 is a plain view of the current interrupting apparatus of according to a third embodiment of the present invention.
Figure 5:
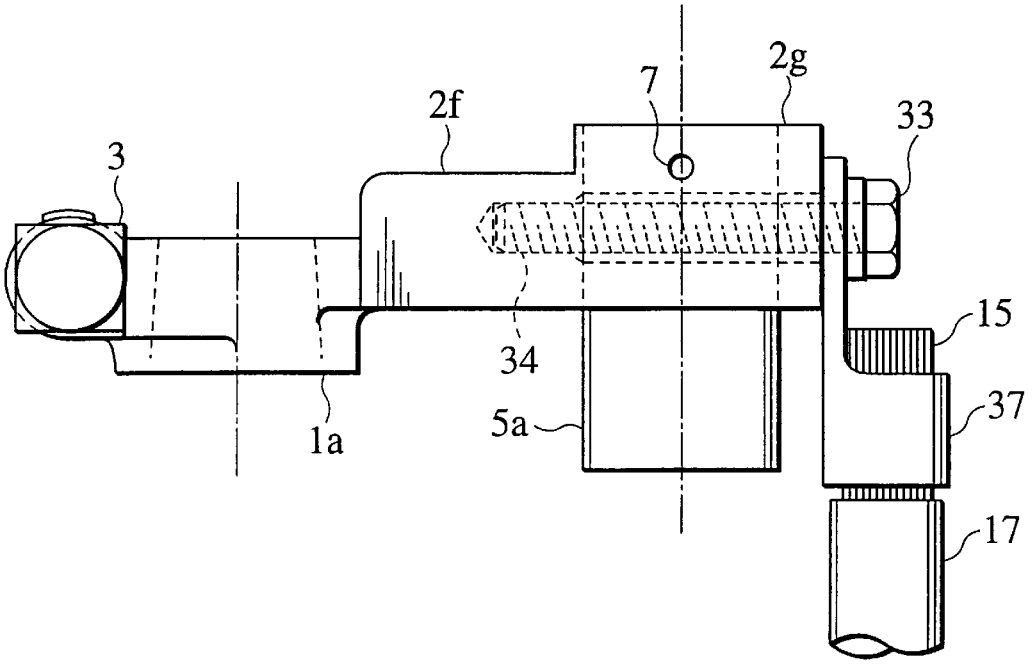
FIG. 5 is a side view showing a current interrupting apparatus according to the embodiment.
Figure 6:
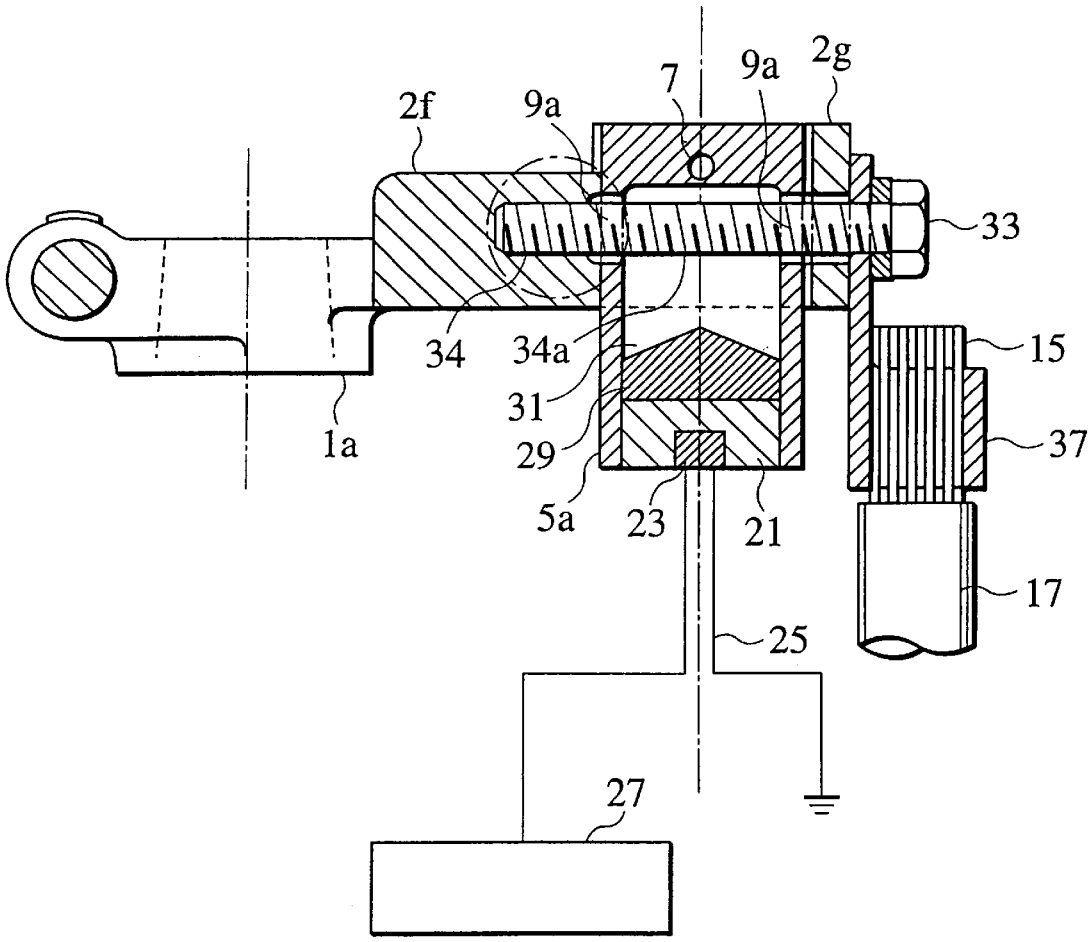
FIG. 6 is a partly sectional view showing the current interrupting apparatus of the embodiment as taken along a line 6—6 in FIG. 4.

Incidentally, in the current interrupting apparatus illustrated in FIGS. 4 to 6, the same components as those of the current interrupting apparatus described in the first embodiment are denoted by like reference symbols, and a detailed explanation thereof will be omitted.

Then, the operation of the current interrupting apparatus according to the third embodiment of the present invention that is constructed in the above-described way is explained.

First, in a case where the vehicle is in an ordinary state, the cutting device 5*a* is kept out of operation. Therefore, the battery terminal 1*a* is electrically connected to the battery cable 17 through the terminal main body portion 2*f*, bolt/nut mechanism 33 and battery-assembling terminal 37, whereby the current is supplied from the battery to the load.

Next, when a vehicle abnormality such as, for example, a vehicle collision has occurred, an abnormality signal is sent from the controller unit 27 to the cutting device 5*a*. Then, the igniting device 23 is ignited with the result that the explosives in the explosive portion 21 are exploded.

For this reason, since the cutter portion 29 is pushed upward by the explosion force of the explosives in the explosives portion 21, the bolt 34*a* is cut by the cutter portion 29.

At this time, the bolt 34*a* receives a force acting toward the battery cable 17 side, and is moved toward this side, due to the reaction force of the push-up force. In addition, the cut bolt 34*a* is pulled rightward due to the weight of the battery cable 17 itself, with the result that the bolt 34*a* is effectively separated from the terminal main body portion 2*f*.

Therefore, the battery-assembling terminal 37 ceases to contact with the battery terminal 1*a*. As a result, the supply of the electric current from the battery to the load is interrupted.

In this way, with the use of the current interrupting apparatus of the third embodiment, also, it is possible to obtain the same effects as those attainable with the current interrupting apparatus of the first embodiment. Also, if removing the cutting device 5*a* from the terminal main body portion 2*f*, the battery terminal 1*a* can be used also as in a case of an ordinary battery terminal.

Next, the current interrupting apparatus according to a fourth embodiment of the present invention will be explained with reference to FIGS. 7 to 9.

Although in the current interrupting apparatus of the third embodiment the battery cable 17 is disposed orthogonally to the terminal main body portion 2*f*, the current interrupting apparatus of the fourth embodiment is characterized in that the battery terminal 17 is disposed in parallel with the terminal main body portion 2*h*.

The battery terminal 1*b* has a large-thickness terminal main body portion 2*h* that is extended from the circular arc portion 2*a*. The terminal main body portion 2*h* has a hole portion formed therein (not illustrated) that has a center axis in the right and left direction in the figures. The cutting device 5*b* is coaxially provided in this hole portion.

The cutting device 5*b* has the pin 7 for fixing this cutting device 5*b* to the terminal main body portion 2*h* and two through-apertures 9*a* that pass through the circular-cylindrical cavity 31 within the cutting device 5*a*. The battery-assembling terminal 37 is fixed to the upper surface of the terminal main body portion 2*h* by the bolt/nut mechanism 33.

The bolt/nut mechanism 33 is formed with the screw thread portion 34 at the forward end of the bolt 34*a*. The bolt/nut mechanism 33 is passed through the through-apertures 9*a* and through the circular-cylindrical cavity 31 and is screwed to the terminal main body portion 2*h* by the screw thread portion 34.

As a result of this, the battery terminal 1*b* and the battery cable 17 are electrically connected to each other through the battery-assembling terminal 37 and the bolt/nut mechanism 33.

Figure 7:
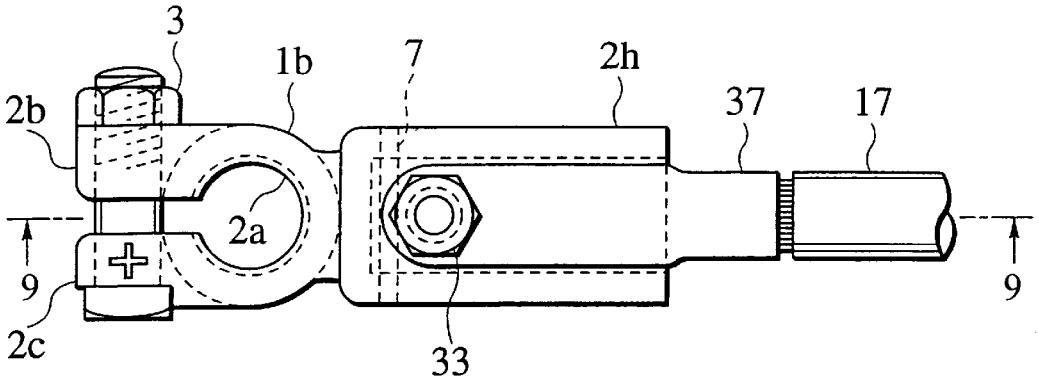
FIG. 7 is a plain view showing a current interrupting apparatus according to a fourth embodiment of the present invention.
Figure 8:
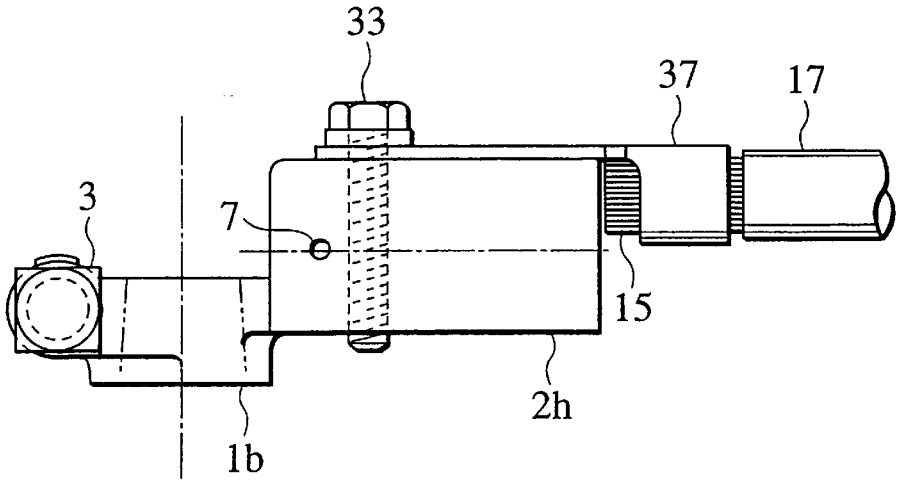
FIG. 8 is a side view showing the current interrupting apparatus of the embodiment.
Figure 9:
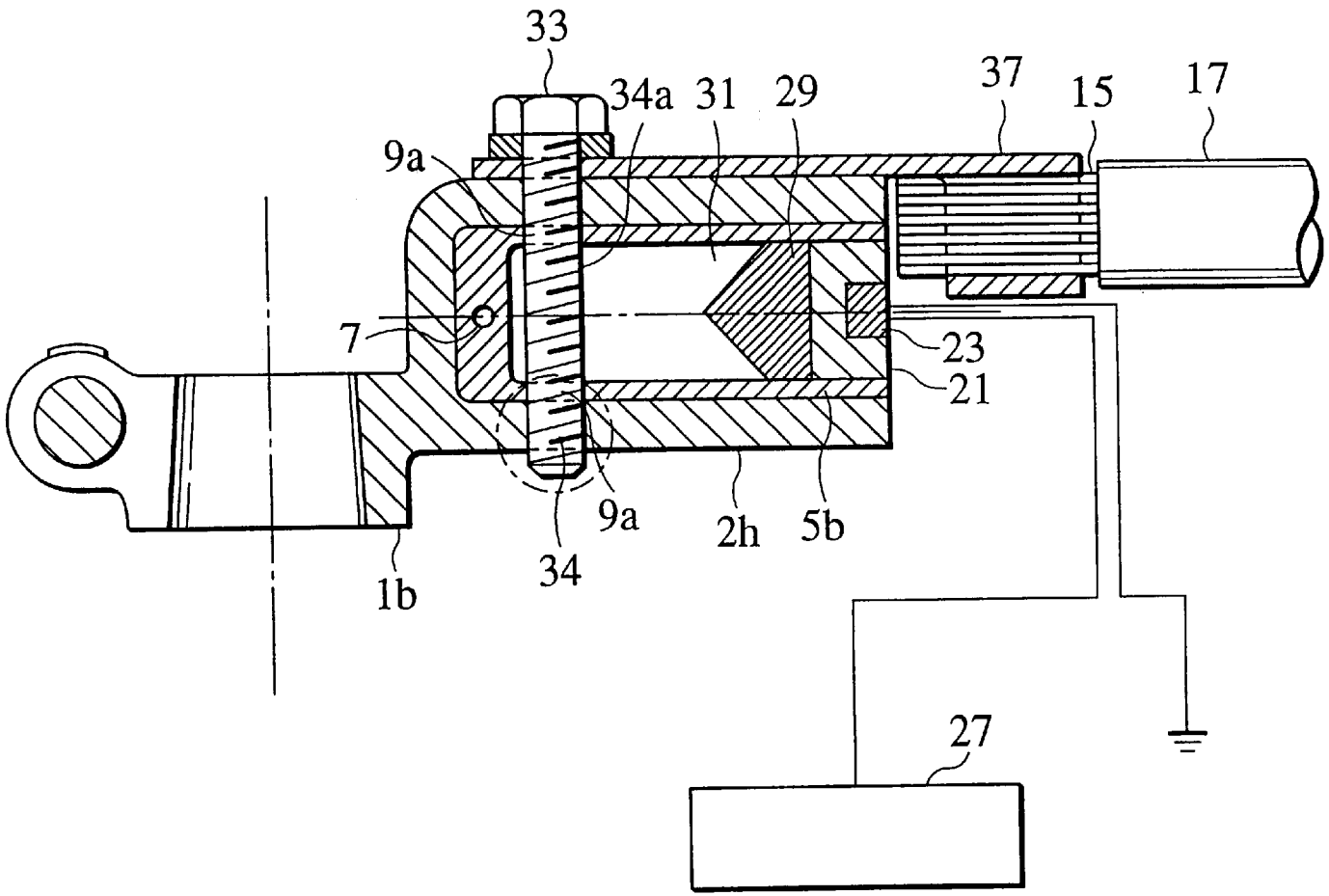
FIG. 9 is a partly sectional view showing the current interrupting apparatus of the present embodiment as taken along a line 9—9 in FIG. 7.

It is to be noted that in the current interrupting apparatus illustrated in FIGS. 7 to 9, the same components as those of the current interrupting apparatus described in the first embodiment are denoted by like reference symbols, and a detailed explanation thereof will be omitted.

According to the current interrupting apparatus of the above-described fourth embodiment, when a vehicle abnormality such as, for example, a vehicle collision has occurred, the cutter portion 29 is moved in the leftward by the explosion force of the explosives in the explosives portion 21, whereby the bolt 34*a* is cut by the cutter portion 29.

Therefore, the battery-assembling terminal 37 ceases to contact with the battery terminal 1*b*. As a result, the supply of the electric current from the battery to the load is interrupted.

Next, the current interrupting apparatus according to a fifth embodiment of the present invention will be explained with reference to FIGS. 10, 11A and 11B.

The current interrupting apparatus of the fifth embodiment is a modified example of the current interrupting apparatus of the third embodiment and is specified in such a manner that the construction of the bolt/nut mechanism and cable-assembling terminal is changed.

Figure 11A:
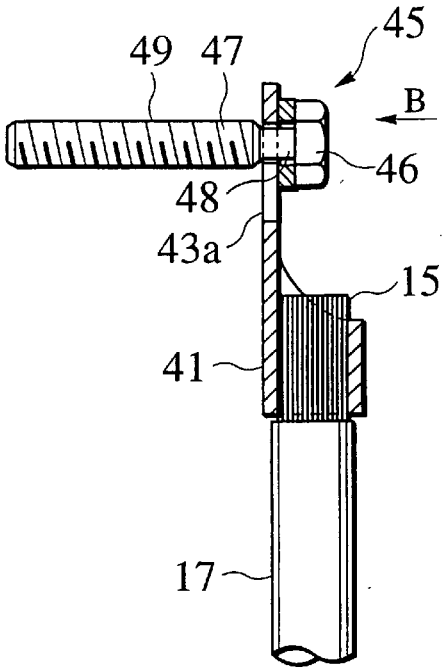
FIG. 11A is a view showing the construction of a cable-assembling terminal and the assembly of the cable-assembling terminal and a bolt/nut mechanism in the current interrupting apparatus ratus of the embodiment.
Figure 11B:
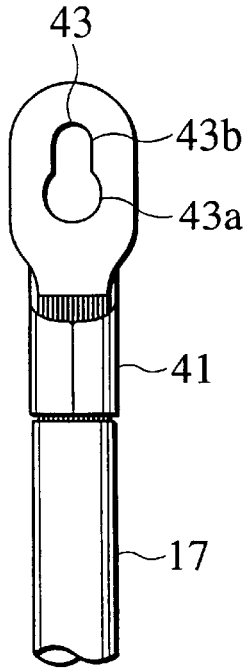
FIG. 11B is a view as taken from the direction of B in FIG. 11A.

In FIGS. 11A and 11B, illustration is made of the construction of the cable-assembling terminal and the assembly of the cable-assembling terminal and bolt/nut mechanism.

As illustrated in FIG. 11B, the cable-assembling terminal 41 that is connected to the battery cable 17 has a hole portion 43 formed therein and shaped in such a manner that the hole portion 43 is formed by a large-diameter hole portion 43*a* and a small-diameter hole portion 43*b*.

Figure 10:
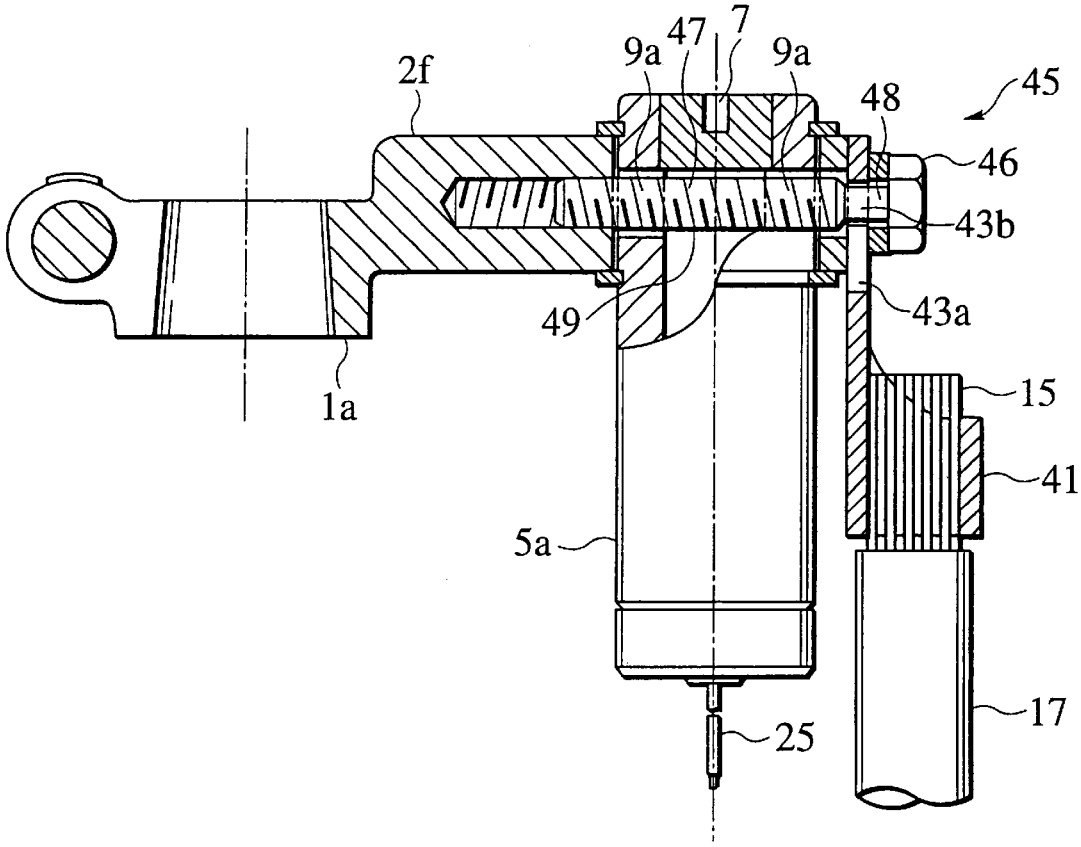
FIG. 10 is a partly sectional view showing a current interrupting apparatus according to a fifth embodiment of the present invention.

As illustrated in FIGS. 10 and 11A, the bolt/nut mechanism 45 includes a head portion 46 and a bolt 47. This bolt 47 is provided with a neck portion 48 and a screw thread portion 49. The neck portion 48 is formed so as to have no screw thread portion, be smaller in diameter than the screw portion 49 and be passed through the small-diameter hole portion 43*b*.

And, the screw thread portion 49 of the bolt 47 is passed through the large-diameter portion 43*a* of the cable-assembling terminal 41. Thereafter, the neck portion 48 of the bolt 47 is moved to the small-diameter portion 43*b* of the cable-assembling terminal 41, whereby the cable-assembling terminal 41 is fixed to the terminal main body portion 2*f* by the bolt/nut mechanism 45.

Besides, it is to be noted that the explosives portion 21, igniting device 23 and cutter portion 29 not illustrated are contained in the cutting device 5*a*.

According to this construction, as same as in a case of the third embodiment when a vehicle abnormality occurs, the bolt 47 is cut by the cutter portion 27 provided in the cutting device 5*a*. The cut bolt 47 receives a force toward the battery cable 17 side (in the rightward direction in FIG. 10) by the reaction force of this cutting operation.

At this time, the outside diameter of the screw thread portion 49 of the bolt 47 is larger than the diameter of the small-diameter hole portion 43*b*, however, the cut bolt 47 surely pushes the cable-assembling terminal 41 out rightwardly. Namely, the cut bolt 47 is moved rightward jointly with the cable-assembling terminal 41.

For this reason, the bolt 47 and the cable-assembling terminal 41 are cut off from the terminal main body portion 2*f*. As a result, the battery terminal la is separated from the bolt 47 and the cable-assembling terminal 41 and therefore the supply of the current to the load is interrupted. In the current interrupting apparatus of this fifth embodiment, the supply of the current can be reliably interrupted while the degree of assembling freedom is being more enhanced than in a case of the current interrupting apparatus of the third embodiment.

Of course, it may be also arranged to apply the bolt/nut mechanism 45 and cable-assembling terminal 41 of the fifth embodiment to the above-described current interrupting apparatus of each of the third and fourth embodiments. If arrangement is made like this, it is possible to obtain the same effects as those attainable with the current interrupting apparatus of the fifth embodiment.

Figure 12A:
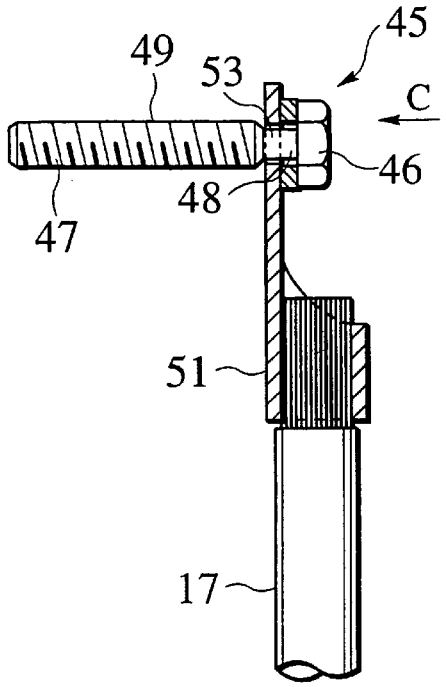
FIG. 12A is a view showing the construction of another cable-assembling terminal and the assembly of the cable-assembling terminal and a bolt/nut mechanism in a current interrupting apparatus.
Figure 12B:
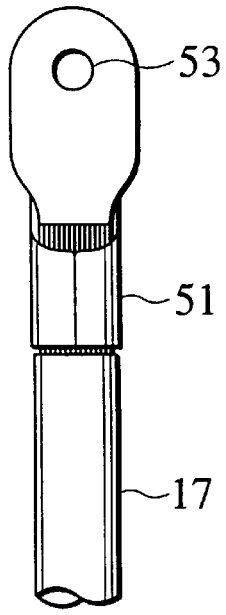
FIG. 12B is a view as taken from the direction of C in FIG. 12A.
Figure 13:
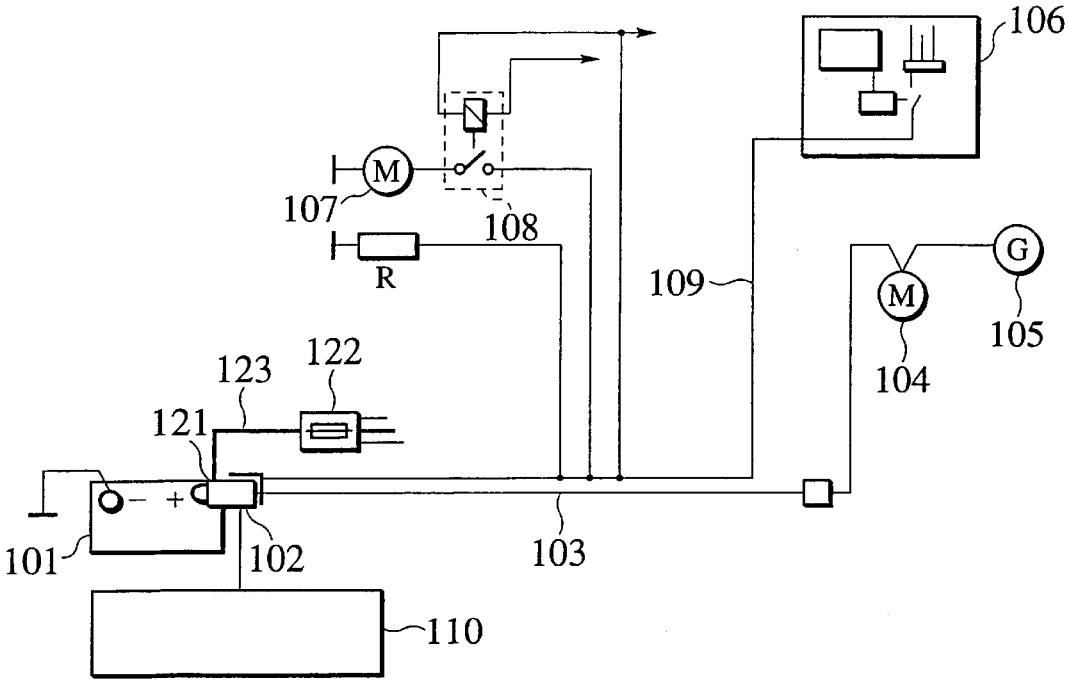
FIG. 13 is a structural view showing an on-vehicle loaded circuitry that has been used when the present inventors have made their studies.
Figure 14:
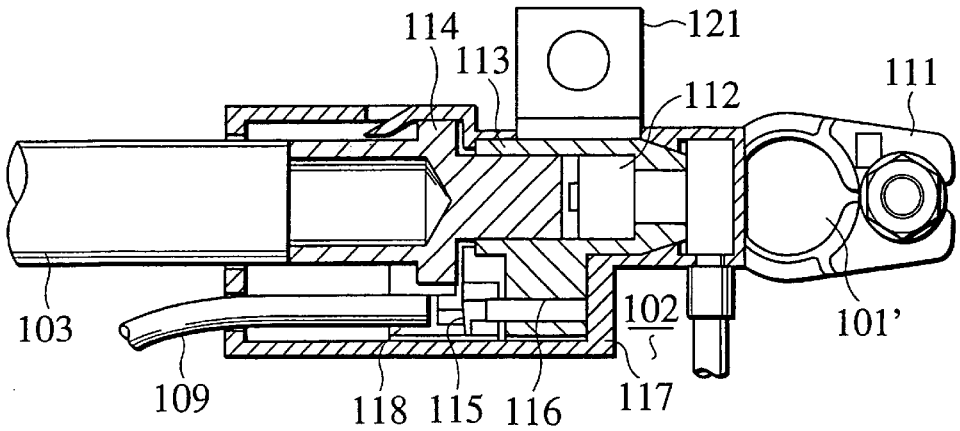
FIG. 14 is a sectional view showing a circuit breaker that has been provided in the on-vehicle-loaded circuitry illustrated in FIG. 13.

In addition, in FIGS. 12A and 12B, illustration is made of another example of the construction of the cable-assembling terminal and the assembly of the cable-assembling terminal and bolt/nut mechanism.

As illustrated in FIG. 12B, the cable-assembling terminal 51 that is connected to the battery cable 17 has formed therein a small-diameter hole portion 53.

It is to be noted that since the construction of the bolt/nut mechanism 45 illustrated in FIG. 12A is substantially the same as that of the bolt/nut mechanism 45 illustrated in FIG. 11A, an explanation thereof will be omitted.

Meanwhile, the cable-assembling terminal 51 is previously passed through a portion of the bolt 47 opposite to the side of the screw thread portion 49 thereof and thereafter an assembling portion (the head 46) of the bolt 47 is formed. That is, in detail, when the bolt/nut mechanism 45 is formed, the cable-assembling terminal 51 is assembled beforehand with respect to this bolt/nut mechanism 45.

In this way, in even the case where the bolt/nut mechanism 45, which has had the cable-assembling terminal 51 previously assembled thereto, is fixed to the terminal main body portion 2*f*, it is possible to obtain the same effects as those attainable with the current interrupting apparatus of the fifth embodiment.

Additionally, the invention is not limited to the above-described current interrupting apparatuses according to the first to the fifth embodiments but of course permits various modifications to be made and executed without departing from the technical concept of the invention.

What is claimed is:

1. A current interrupting apparatus comprising:

a battery terminal adapted to attach to a battery;

a load conductor wire adapted to connect to a load;

a connecting member attached to the battery terminal and electrically connecting the load conductor wire and the battery terminal; and a cutting device configured to cut the connecting member when an interruption control signal is input thereto, wherein a supply of an electric current from the battery to the load by way of the battery terminal and the load conductor wire is interrupted when the cutting device cuts the connecting member.

2. A current interrupting apparatus according to claim 1, wherein the cutting device comprises an explosives portion accommodating explosives, an igniting device igniting the explosives accommodated in the explosives portion, and the cutter portion cutting the connecting member by use of an explosion force generated by the explosives when the explosives are ignited by the igniting device.

3. A current interrupting apparatus according to claim 1, wherein the cutting device is inserted into a part of the battery terminal and is fixed therein.

4. A current interrupting apparatus according to claim 3, wherein the cutting device is inserted into a terminal main body of the battery terminal and is fixed therein.

5. A current interrupting apparatus according to claim 1, wherein the connecting member has a conductor wire-assembling terminal connecting to the load conductor wire and an attaching portion attaching the conductor wire-assembling terminal to the battery terminal, and the cutting device cuts the conductor wire-assembling terminal.

6. A current interrupting apparatus according to claim 5, wherein the conductor wire-assembling terminal is passed through a cavity portion formed within the cutting device, and the cutting device cuts the conductor wire-assembling terminal passed through the cavity portion.

7. A current interrupting apparatus according to claim 1, wherein the connecting member has a conductor wire-assembling terminal connecting to the load conductor wire and an attaching portion attaching the conductor wire-assembling terminal to the battery terminal, and the cutting device cuts the attaching portion.

8. A current interrupting apparatus according to claim 1, wherein the attaching portion is a fastening portion fastening and fixing the conductor wire-assembling terminal to the battery terminal, the fastening portion is passed through a cavity portion formed within the cutting device, and the cutting device cuts the fastening portion passed through the cavity portion.

9. A current interrupting apparatus according to claim 1, wherein the connecting member has a conductor wire-assembling terminal connecting to the load conductor wire and an attaching portion attaching the conductor wire-assembling terminal to the battery terminal, and the conductor wire-assembling terminal is extended in a vertical direction.

10. A current interrupting apparatus comprising:

a battery terminal adapted to attach to a battery;

a load conductor wire adapted to connect to a load;

a connecting member electrically connecting the load conductor wire and the battery terminal; and a cutting device configured to cut the connecting member when an interruption control signal is input thereto, wherein a supply of an electric current from the battery to the load by way of the battery terminal and the load conductor wire is interrupted when the cutting device cuts the connecting member, wherein the connecting member has a conductor wire-assembling terminal connecting to the load conductor wire and an attaching portion attaching the conductor wire-assembling terminal to the battery terminal, and the cutting device cuts the attaching portion, wherein the attaching portion is a fastening and fixing the conductor wire-assembling terminal to the battery terminal, the fastening portion is passed through a cavity portion formed within the cutting device, and the cutting device cuts the fastening portion passed through the cavity portion, and wherein the fastening portion has a bolt passed through the cavity formed within the cutting device, and the cutting device cuts the bolt.

11. A current interrupting apparatus comprising:

a battery terminal adapted to attach to a battery;

a load conductor wire adapted to connect to a load;

a connecting member electrically connecting the load conductor wire and the battery terminal; and a cutting device configured to cut the connecting member when an interruption control signal is input thereto, wherein a supply of an electric current from the battery to the load by way of the battery terminal and the load conductor wire is interrupted when the cutting device cuts the connecting member, wherein the connecting member has a conductor wire-assembling terminal connecting to the load conductor wire and an attaching the conductor wire-assembling terminal to the battery terminal; the conductor wire-assembling terminal has a hole portion; the attaching portion is a fastening and fixing the conductor wire-assembling terminal to the battery terminal; and the fastening portion has a head portion, a neck portion joining to the head portion and passing through the hole portion, and a bolt joining to the neck portion and having a screw portion whose diameter is larger than a diameter of the hole portion and that is cut by the cutting device.

12. A current interrupting apparatus comprising:

a battery terminal adapted to attach to a battery;

a load conductor wire adapted to connect to a load;

a connecting member electrically connecting the load conductor wire and the battery terminal; and a cutting device configured to cut the connecting member when an interruption control signal is input thereto, wherein a supply of an electric current from the battery to the load by way of the battery terminal and the load conductor wire is interrupted when the cutting device cuts the connecting member, wherein the connecting member has a conductor wire-assembling terminal connecting to the load conductor wire and an attaching portion attaching the conductor wire-assembling terminal to the battery terminal; the conductor wire-assembling terminal has a hole portion having a large-diameter portion and a small-diameter portion; the attaching portion is a fastening portion fastening and fixing the conductor wire-assembling terminal to the battery terminal; and the fastening portion has a head portion, a neck portion joining to the head portion and passed through the hole portion, and a bolt joining to the neck portion and having a screw portion whose diameter is larger than a diameter of the small-diameter portion of the hole portion and that is cut by the cutting device.

* * * * *

UNITED STATES PATENT AND TRADEMARK OFFICE

CERTIFICATE OF CORRECTION

PATENT NO. : 6,232,568 B1
DATED : May 15, 2001
INVENTOR(S) : Tetsuya Hasegawa et al.

It is certified that error appears in the above-identified patent and that said Letters Patent is hereby corrected as shown below:

Column 2,
Line 21, insert -- to -- between "connector" and "the".

Column 3,
Line 7, delete ",".

Column 5,
Line 9, change "to" to -- in --; and
Line 19, delete second occurrence of "that".

Column 7,
Line 24, in "l a" bold the "1" and italicize the "a".

Column 9,
Line 2, insert -- direction -- between "leftward" and "by".
Line 58, in "l a" bold the "1" and italicize the "a".

Column 10,
Line 2, insert -- an --between "If" and "arrangement".

Column 11,
Line 44, insert -- fastening portion -- between "a" and "fastening".

UNITED STATES PATENT AND TRADEMARK OFFICE

CERTIFICATE OF CORRECTION

PATENT NO. : 6,232,568 B1
DATED : May 15, 2001
INVENTOR(S) : Tetsuya Hasegawa et al.

It is certified that error appears in the above-identified patent and that said Letters Patent is hereby corrected as shown below:

Column 12,
Line 14, insert -- portion attaching -- between "attaching" and "the";
Line 17, insert -- portion fastening -- between "fastening" and "and", and
Lines 47, changed "passed" to -- passing --.

Signed and Sealed this

Fifth Day of February, 2002

*Attest:*

*Attesting Officer*

JAMES E. ROGAN
*Director of the United States Patent and Trademark Office*